US007845894B2

(12) United States Patent
Dickinson et al.

(10) Patent No.: US 7,845,894 B2
(45) Date of Patent: Dec. 7, 2010

(54) SHIPPING CONTAINER

(76) Inventors: Randall Douglas Dickinson, 5 Old Alewive Rd., Kennebunk, ME (US) 04043; Patrick Joseph Horan, 104 Belknap St., Dover, NH (US) 03820

( * ) Notice: Subject to any disclaimer, the term of this patent is extended or adjusted under 35 U.S.C. 154(b) by 478 days.

(21) Appl. No.: 11/800,960

(22) Filed: May 8, 2007

(65) Prior Publication Data

US 2008/0000397 A1 Jan. 3, 2008

Related U.S. Application Data

(60) Provisional application No. 60/798,599, filed on May 8, 2006.

(51) Int. Cl.
*B65G 7/00* (2006.01)

(52) U.S. Cl. ..... 414/430; 414/258

(58) Field of Classification Search ..... 206/386, 206/595–600, 320; 108/57.33, 57.15, 57.16, 108/57.17, 55.3; 193/38, 41; 414/427, 430, 414/258, 337, 571, 679; 254/104
See application file for complete search history.

(56) References Cited

U.S. PATENT DOCUMENTS

| | | | | |
|---|---|---|---|---|
| 3,891,086 | A * | 6/1975 | Isaacs | 206/320 |
| 5,133,459 | A | 7/1992 | Genix | |
| 5,911,179 | A * | 6/1999 | Spiczka | 108/51.11 |
| 6,035,790 | A * | 3/2000 | Polando | 108/55.1 |
| 6,105,511 | A | 8/2000 | Bridges | |
| 6,240,854 | B1 * | 6/2001 | Heil | 108/51.11 |
| 6,539,881 | B2 * | 4/2003 | Underbrink et al. | 108/55.3 |
| 6,769,368 | B2 | 8/2004 | Underbrink et al. | |
| 2004/0108238 | A1 | 6/2004 | Maresh | |

* cited by examiner

*Primary Examiner*—J. Gregory Pickett
(74) *Attorney, Agent, or Firm*—Kriegsman & Kriegsman

(57) ABSTRACT

A shipping container for a product mounted on casters, weighing on the order of about 150 to 300 pounds and including a box shaped housing. The shipping container comprises a base. A pair of elongated, parallel disposed and spaced apart support members are fixedly mounted on the top of the base. Each support member includes a block of foam material fixedly mounted onto the base and having a tapered front end and a rear end. A strip of low friction material is fixedly mounted on top of the block of foam material.

2 Claims, 9 Drawing Sheets

SHIPPING CONTAINER

CROSS-REFERENCE TO RELATED APPLICATIONS

This application claims the benefit of U.S. Provisional Patent Application Ser. No. 60/798,599 entitled Shipping Container filed on May 8, 2006, which application is herein incorporated by reference.

BACKGROUND OF THE INVENTION

The present invention relates generally to shipping containers and more particularly to shipping containers for products mounted on casters.

Shipping containers for products mounted on casters often include some type of ramp to assist in loading the product into the container and then unloading the product from the container once it reaches its destination.

Although the invention will hereinafter be described with regard to a shipping container for use in holding a chiller which is mounted on casters and sized for use in single point applications it is to be understood that the invention is not intended to be limited exclusively to shipping containers for chillers or shipping containers for chillers used in single point applications.

As is known, a chiller is a piece of equipment which outputs a liquid, such as water, at a user defined temperature which is used to regulate the temperature of a device such as a welding machine or a laser.

Chillers used in single point applications generally weigh in the order of about 125 to 300 pounds and are generally sized about 2 feet by about 3 feet by about 3 feet.

In U.S. Pat. No. 5,911,179 to D. Spiezka there is disclosed a pallet including a ramp and two slide assemblies inserted between the pallet surface and the article to be shipped. The ramp is pivotally attached as part of the pallet structure and may be folded up during shipping and down during unloading. The slide assemblies include a strip of material with low coefficient of friction to facilitate sliding on the pallet surface and the ramp.

In U.S. Patent Application Publication No. US2004/0108238 to M. E. Maresh there is disclosed a shipping carton with a ramp system which is integrated into the packaging in a unique way which facilitates positioning of the ramp system for use while also facilitating storage of the ramp system during shipment of the product enclosed within the packaging.

In U.S. Pat. No. 5,133,459 to P. D. Genix there is disclosed a shipping container for an article which includes a floor on which the article is placed, the top surface of which is elevated from the supporting surface upon which the container rests, by a fixed dimension. Four side structures surround the floor and a top panel contacts the side structures to form an enclosure for the article. One of the side structures has at least one flap that, when opened, permits a ramp, that is part of the side structure, in the form of an inclined plane, to be pivoted into position against the floor. The height of the inclined plane approximates the fixed dimension so that the article can be moved horizontally within the container and then down the ramp for removal. Reinstallation of the article into the container requires moving the article up the inclined plane, onto the floor of the container.

In U.S. Pat. No. 6,105,511 to J. W. Bridges there is disclosed a packaging assembly for computer cabinets which includes a base having a support surface, a pallet on one side of the support surface and a support guide on the other side of the support surface. A computer cabinet is mounted on the support surface and secured to the support guide. A two-piece cover is mounted over the cabinet and secured to the base. The two pieces of the cover are secured together by removable connectors. A cap is removably mounted on an end of the cover opposite the base and secured to the cover by additional ones of the removable connectors.

In U.S. Pat. No. 6,240,854 to J. F. Heil there is disclosed palletizing system for a wheeled item comprising an undercarriage and wheels extending from the undercarriage. The pallet includes a plurality of ramps on a base frame sloping from a support toward the base frame and the palletizing system includes at least one selectively removable bridging member for placement in one of the plurality of ramps for forming a track along which the wheels of the item can roll over the one of the plurality of ramps. The support and the plurality of ramps are structured and arranged so that when the bridging member is removed from at least one of the plurality of ramps and the wheeled item is shifted on the wheels from the support surface along the plurality of ramps, the undercarriage of the wheeled item comes to rest on the support surface.

In U.S. Pat. No. 6,769,368 to S. L. Underbrink et al. there is disclosed a pallet and an associated method for supporting an item mounted upon casters. The pallet includes a pallet deck having a fixed portion and a movable portion. The movable portion moves between the first position in which the movable portion is displaced, such as by being rotated downwardly, from the fixed portion and a second position in which the movable and fixed portions cooperate to define a support surface. The movable portion is in the second position while the item is loaded, but is moved to the first position during shipment. The pallet also includes a support for supporting the item once the movable portion is in the first position. Prior thereto, however, the item is typically spaced from the support. Each support can include a stationary portion and a movable portion that moves between a retracted position to facilitate loading and an extended position during shipment.

In the past, shipping containers for chillers mounted on casters and used in single point applications did not include a ramp and required at least two people to load the chiller into the container and then unload the chiller from the container once it reaches it location.

It is an object of this invention to provide a new and improved shipping container.

It is another object of this invention to provide a shipping container for use with a product mounted on casters.

It is still another object of this invention to provide a shipping container for use with chillers used in single point applications.

It is yet still another object of this invention to provide a shipping container for a chiller mounted on casters and used in a single point application which is constructed so as to permit the chiller to be loaded into and out of the container by a single person.

It is a further object of this invention to provide a new and improved shipping container which includes a ramp and a method of use.

SUMMARY OF THE INVENTION

According to one aspect of this invention, there is provided a shipping container for holding a product mounted on casters, the product including a housing having a bottom wall, the shipping container comprising a base having a front, a top surface and a bottom surface, a pair of parallel disposed spaced apart support members fixedly mounted on the top surface of the base, each support member comprising a block of foam material and a strip of low friction material, the block of foam material having a tapered front end and a top surface, the strip of low friction material being fixedly mounted on the top surface of the block of foam material, a ramp hingedly mounted onto the front of the base, a sleeve for encircling the product and a cover for covering the sleeve, wherein, the product can be rolled up the ramp, then pushed up the tapered front end of each support member with the casters suspended on either side of the support members and then slid along the strip of low friction material of each support member to the end thereof with the bottom wall of the product seated on the two strips of low friction material and the casters spaced upward from the base.

According to another aspect of this invention a method is provided for loading a product mounted on casters onto a shipping container, the product including a housing having a bottom wall, the shipping container comprising a base, a pair of parallel disposed spaced apart support members fixedly mounted on the base, each support member comprising a block of foam material having a tapered front end and a strip of low friction material on top of each block of foam material, a ramp hingedly mounted onto the base, a sleeve and a cover, the method comprising pivoting the ramp to a down position, then, rolling the product up the ramp, then, pushing the product up the tapered front end of the block of foam material of each support member, then, sliding the product along the strips of low friction material so that the housing of the product is resting on the two elongated support members with the casters suspended on either side of the two support members, and spaced upward from the base of the shipping container, then, sliding the sleeve over the product so that the sleeve is resting on the base in a vertical orientation, then pivoting the ramp to an up position, then affixing the ramp to the sleeve using hot glue or Velcro, and then placing the cover over the sleeve and ramp.

Various other features and advantages will appear from the description to follow. In the description, reference is made to the accompanying drawings which form a part thereof, and in which is shown by way of illustration, an embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
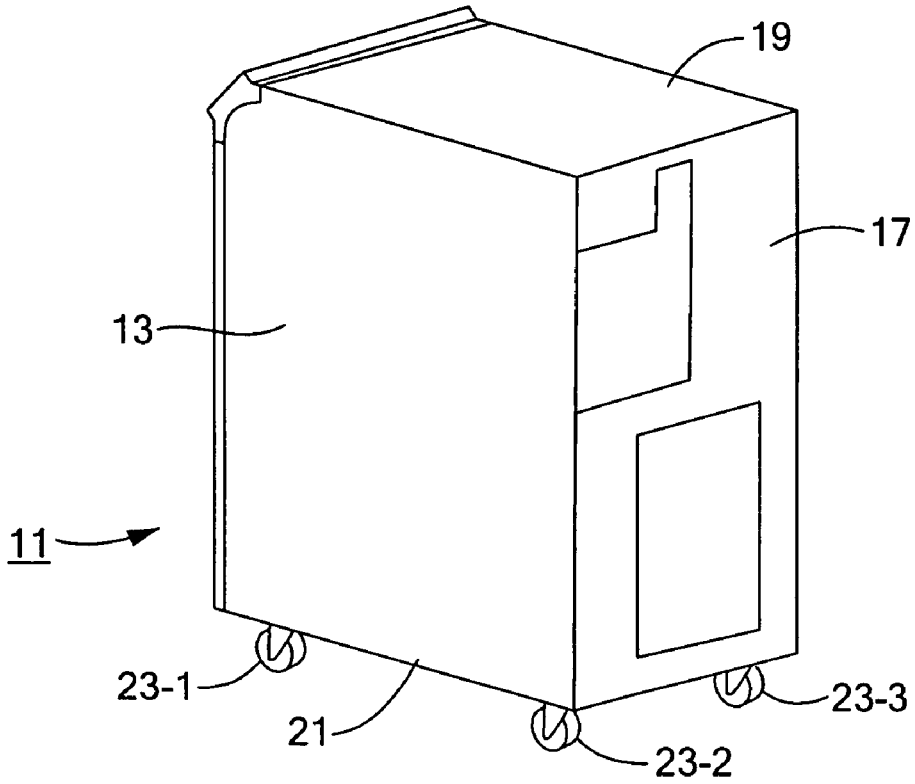
FIG. 1 is a perspective view of a chiller for use in single point applications.
Figure 1A:
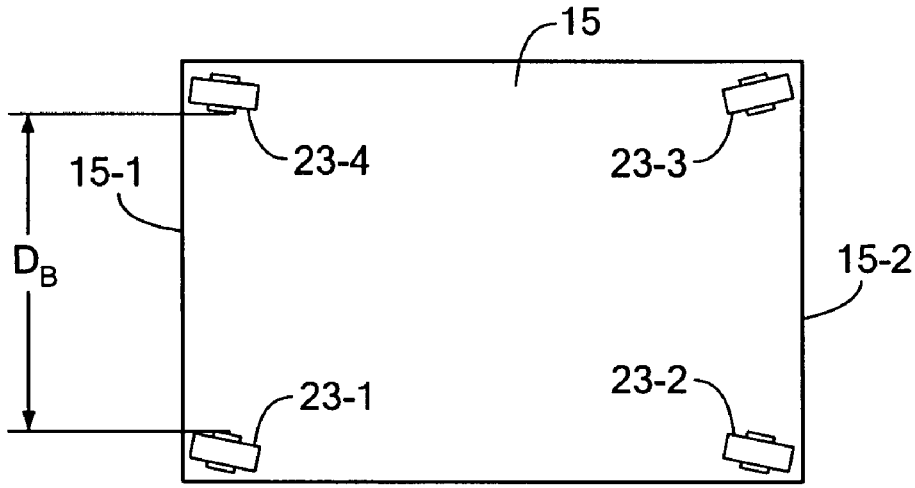
FIG. 1A is a bottom view of the chiller shown in FIG. 1.

Referring now to the drawings, there is shown in FIG. 1 a perspective view of a chiller for use in single point applications, the chiller being identified by reference numeral 11.

Chiller 11 has a generally box shaped housing 13 which includes a bottom wall 15 having a front edge 15-1 and a back edge 15-2, a back wall 17, a top wall 19 and four sidewalls, one of which is shown in FIG. 1 and labeled 21. Chiller 11 weighs about 150 pounds and has dimensions of about 2 feet by 3 feet by about 3 feet. Chiller 11 also includes a set of four casters 23-1 although 23-4, one on each bottom corner of bottom wall 15, casters 23-1 and 23-2 being on the right side of bottom wall 15 and casters 23-3 and 23-4 being on the top side of bottom wall 15.

Figure 1B:
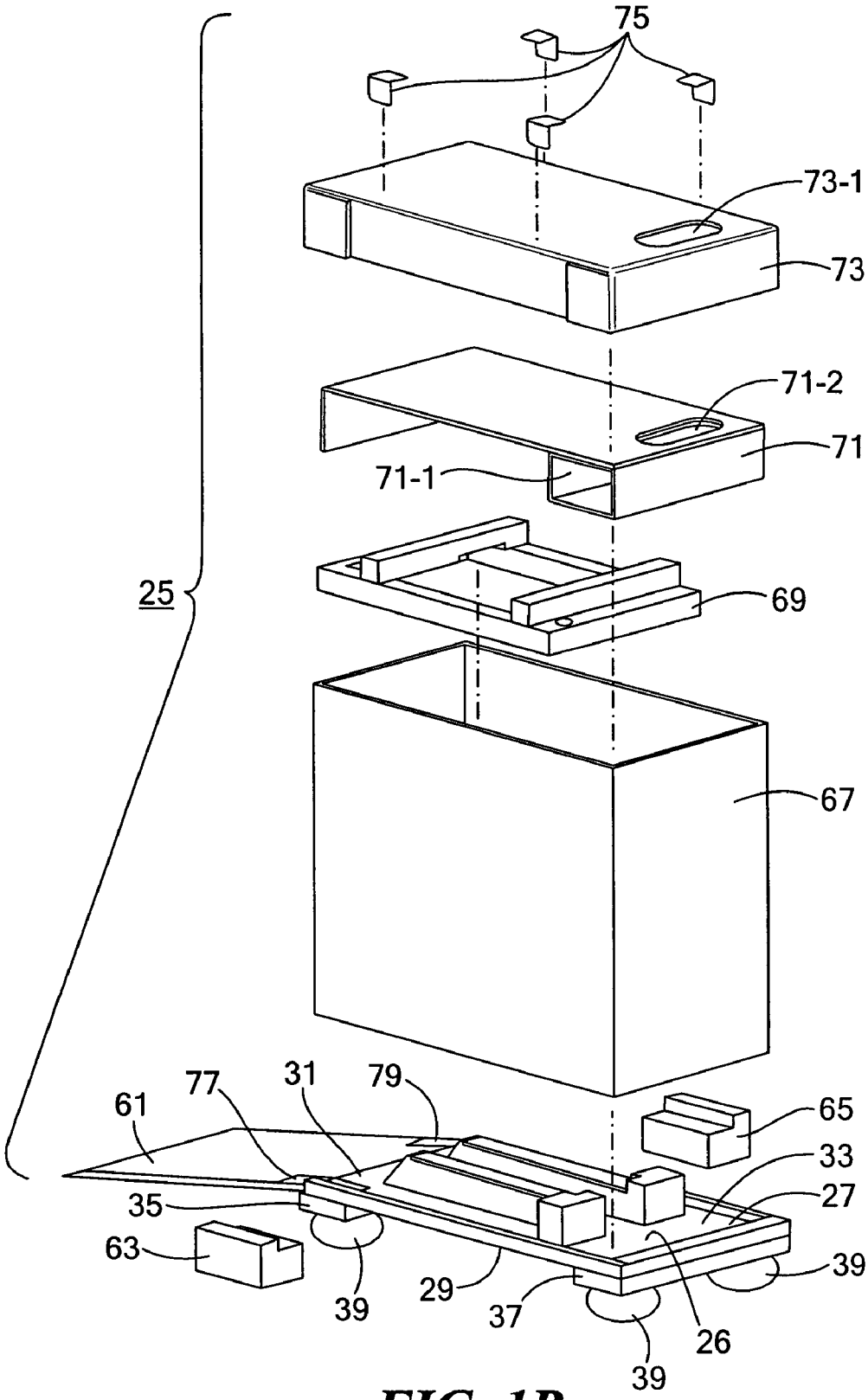
FIG. 1B is a perspective view, partly exploded of a shipping container according to this invention into which the chiller in FIG. 1 may be loaded.

Referring now to FIG. 1B there is shown a perspective view, partly exploded, of a shipping container 25 for holding chiller 11.

Figure 1D:
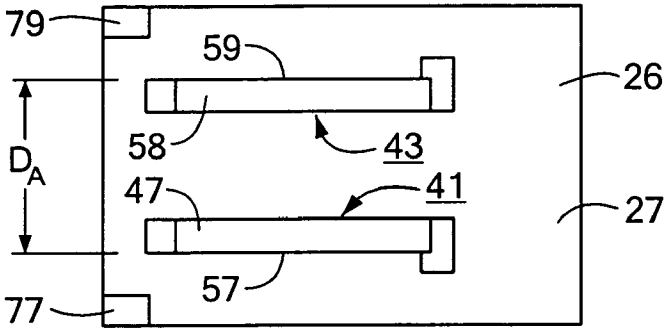
FIG. 1D is a top view of the base of the shipping container showing the two support members.
Figure 1C:
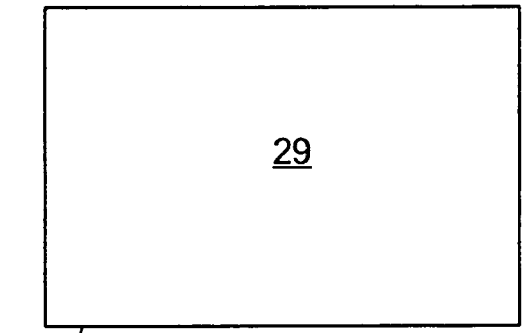
FIG. 1C is a bottom view of the base of the shipping container shown in FIG. 1B.

Shipping container 25 includes a rectangular base 26 made of plywood or other suitable material. Base 26 includes a top surface 27, a bottom surface 29 (see FIG. 1C), a front end 31 and a rear end 33. A pair of wood 2×6"S 35 and 37 are fixedly secured to bottom surface 29 of base 25, 2×6" 35 being located at the front end 31 of base 25 and 2×6" 37 being located at the rear end 33 of base 25. A pair of wood 1×1 side pieces 38-1 are fixedly secured to top surface 27 of base 26 and a 1×2 wood end piece 38-2 is fixedly secured to 2×6" 38. A set of four cushions 39 are provided for supporting base 26 on a surface such as a floor, one cushion 39 being disposed below each corner of base 25.

Two cushions 39 are bolted to 2×6 35 and the other two cushions 39 are bolted to 2×6 37.

A pair of support members 41 and 43 for supporting chiller 11 are longitudinally disposed parallel and spaced apart on top surface 27 of base 25. The spacing of support members 41 and 43 allow adequate support for chiller 11 during shipment and for pivotal action of the casters when unloaded. The spacing is adequate enough to prevent jamming and locking of chiller 11 on support members 41 and 43. Support member 41 comprises an elongated block 45 of polyethylene foam and a strip 47 of low friction material such as MASONITE® construction board. Block 45 includes a main body portion 49, a downwardly tapered front end 51 and a stop portion 53. Support member 43 is a mirror image of support member 41 and includes an elongated block 55 of polyethylene foam having a tapered front end 56 and a stop portion 57 and a strip 58 of low friction material such as MASONITE® construction board. Blocks 45 and 55 are glued onto top surface 27 of base 25 and strips 47 and 58 are glued onto blocks 45 and 55, respectively.

Figure 4:
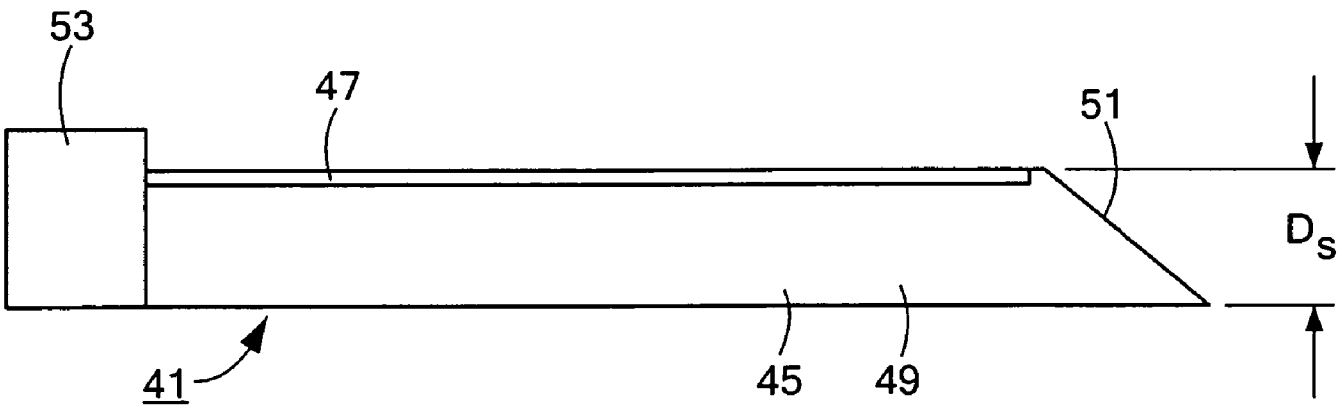
FIG. 4 is a left side view of the right elongated support member shown in FIG. 2.

The distance $D_s$ from the top of strip 47 to the bottom of main body portion 49 of support member 41 (see FIG. 4) is greater than the height $H_c$ of casters 23 and the distance $D_A$ from the outer side 57 of main body portion 49 support member 41 to the outer side 59 of main body portion 60 support member 43 (see FIG. 1D) is less than the distance $D_B$ between casters 23 on one side of chiller 13 and casters 23 on the other side of chiller 13.

Shipping container 25 further includes a ramp 61, a pair of bottom supports 63 and 65, a sleeve 67, a top cap 69, a sheet 71 and a cover 73.

Ramp 61 is made out of plywood, has a tapered front end 75 and is hingedly attached to the top surface 27 of base 26 by a pair of nylon strap hinges 77 and 79. The grain of the plywood of ramp 61 is oriented in parallel with the sliding and loading motion of chiller 11 to optimize strength of the design. Sleeve 67 is made of cardboard. Top cap 69 is made out of polyethylene foam. Sheet 71 and cover 73 are made out of cardboard. Sheet 71 includes a pocket 71-1 for holding miscellaneous pieces of chiller 11. Pocket 71-1 can be accessed through a slot 71-2. Cover 73 includes a slot 73-1 for accessing slot 71-3.

Chiller 11 is loaded into shipping container 25 in the following manner.

Figure 2:
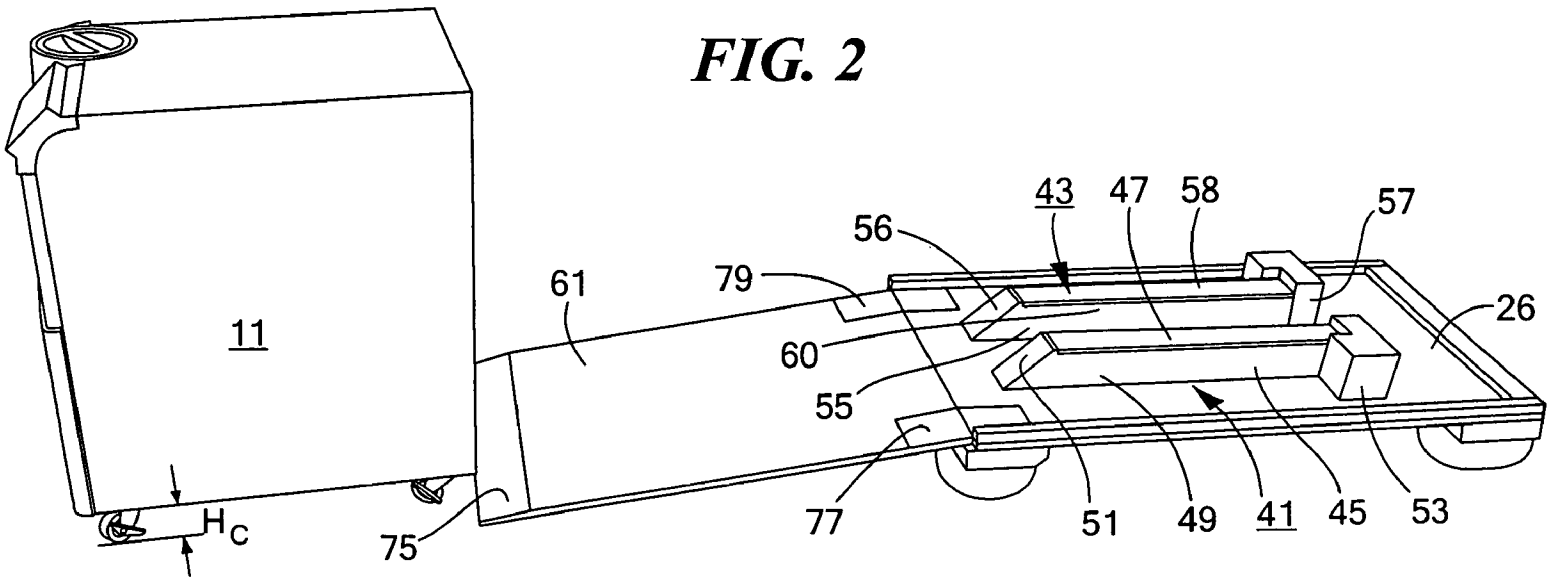
FIG. 2 is a perspective view showing the chiller in FIG. 1 in position for loading onto the shipping container shown in FIG. 1B.
Figure 3:
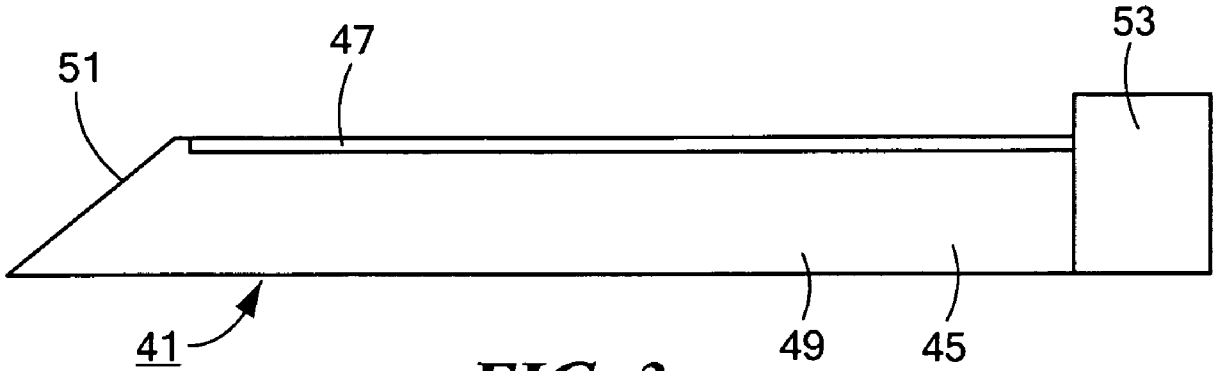
FIG. 3 is a right side view of the right elongated support member shown in FIG. 2.
Figure 5:
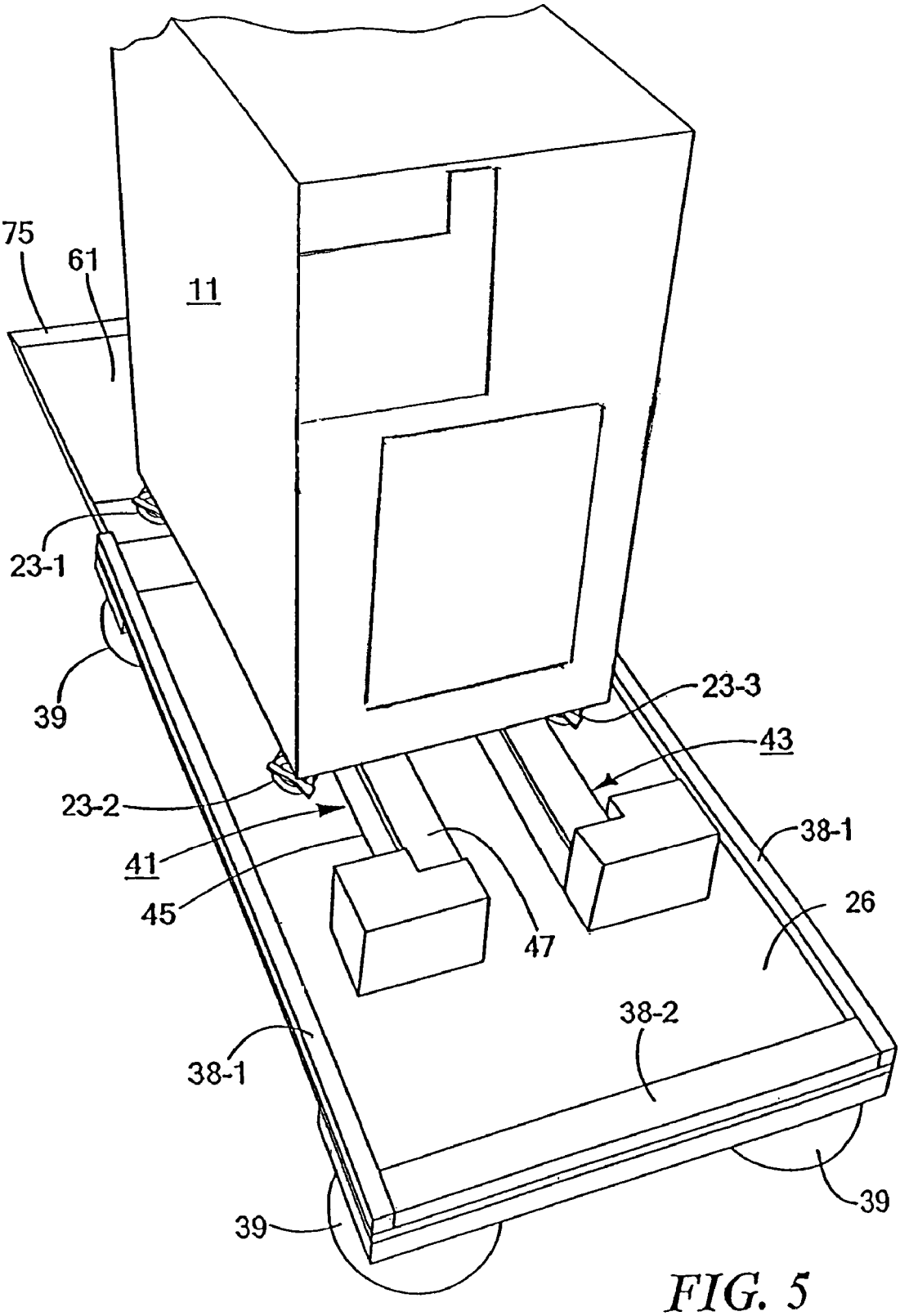
FIG. 5 is a perspective view from the rear showing the chiller in FIG. 1 after it is rolled up the ramp in the shipping container and partially on the two elongated support members.
Figure 6:
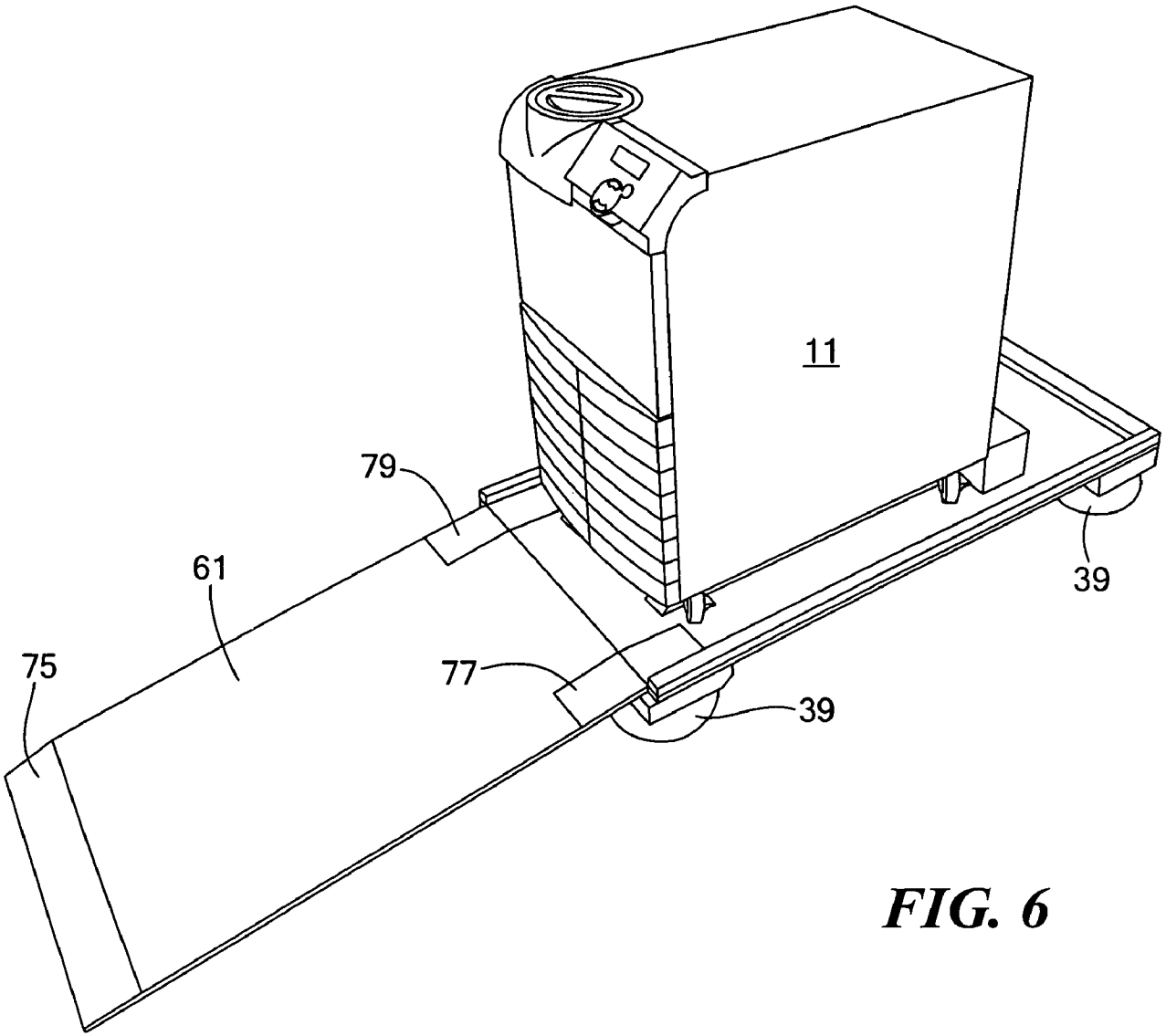
FIG. 6 is a perspective view from the front showing the chiller after it pushed all the way down to the stop portions at back end of the two elongated support members shown in FIG. 2.

First, ramp 61 is pivoted to a down position and chiller 11 is positioned to the left of ramp 61 as shown in FIG. 2. Then, chiller 11 is rolled up ramp 61. Then chiller 11 is pushed up the tapered front ends 51 and 56 of blocks 45 and 55 with casters 23 on either side of front ends 51 and 56. Then, chiller 11 is slid along strips 47 and 48 as shown in FIG. 5 with bottom wall 15 of housing 13 contacting strip 47 and 58 and casters 23 on either side of strips 47 and 58 and spaced upward from base 26. Then chiller 11 is slid along strips 47 and 58 until housing 13 reaches stops 53 and 57 as shown in FIGS. 6 and 7.

Figure 7:
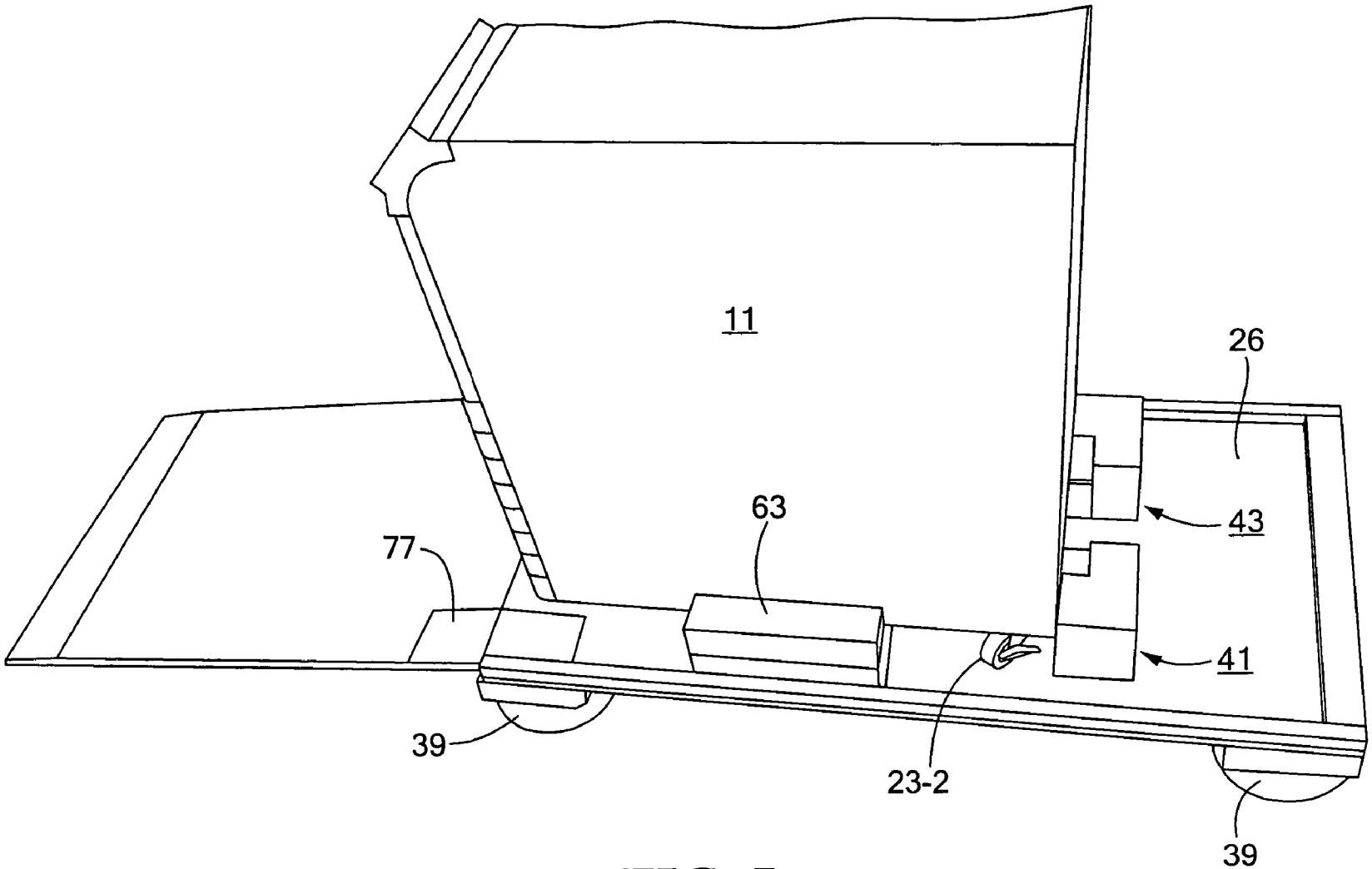
FIG. 7 is a perspective view taken from the side of the chiller resting on the two elongated support members as shown in FIG. 6 and the bottom supports inserted in place.
Figure 8:
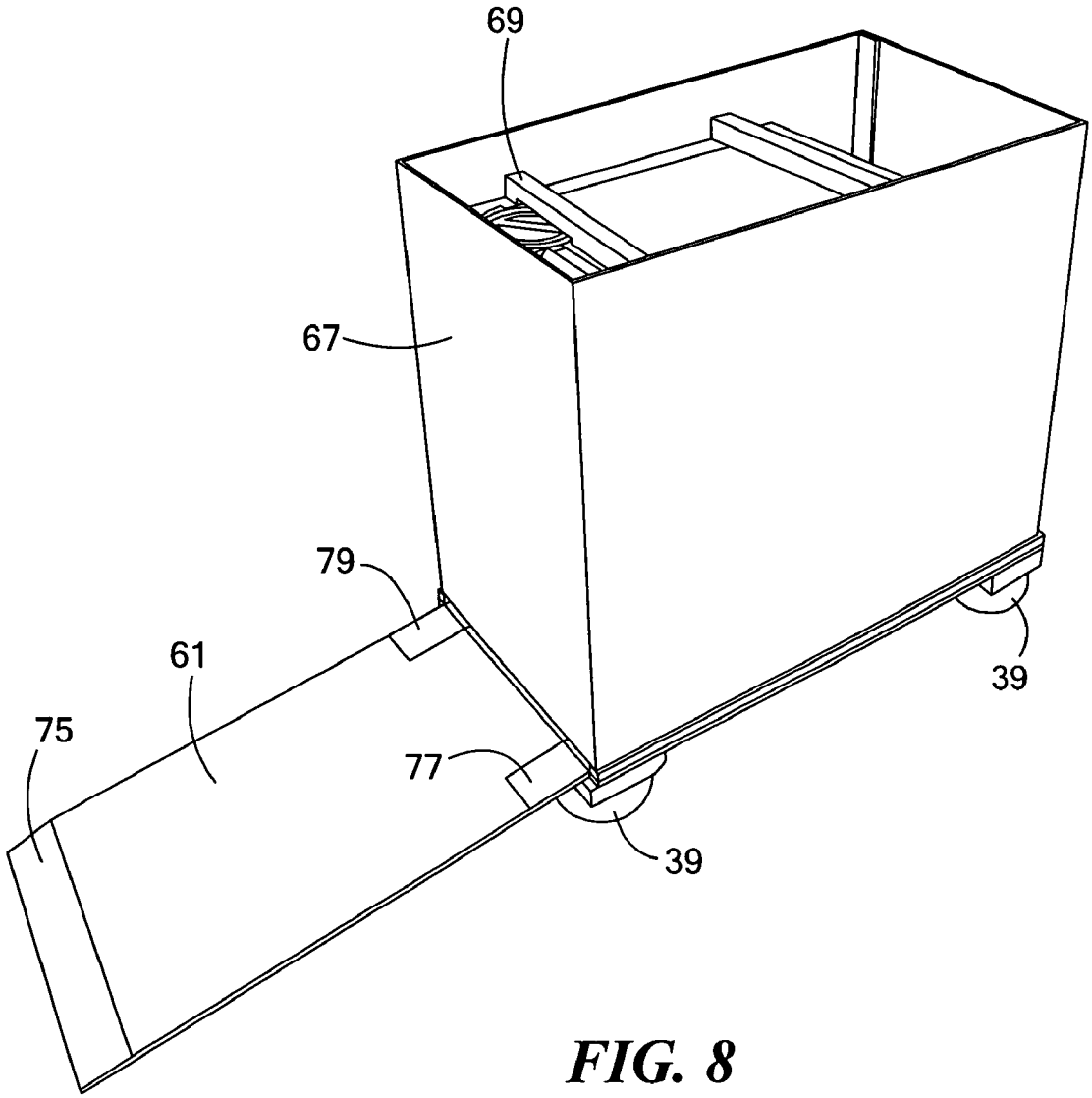
FIG. 8 is a perspective view similar to FIG. 6 but with sleeve and the top cap in place over the chiller and seated on the base.
Figure 10:
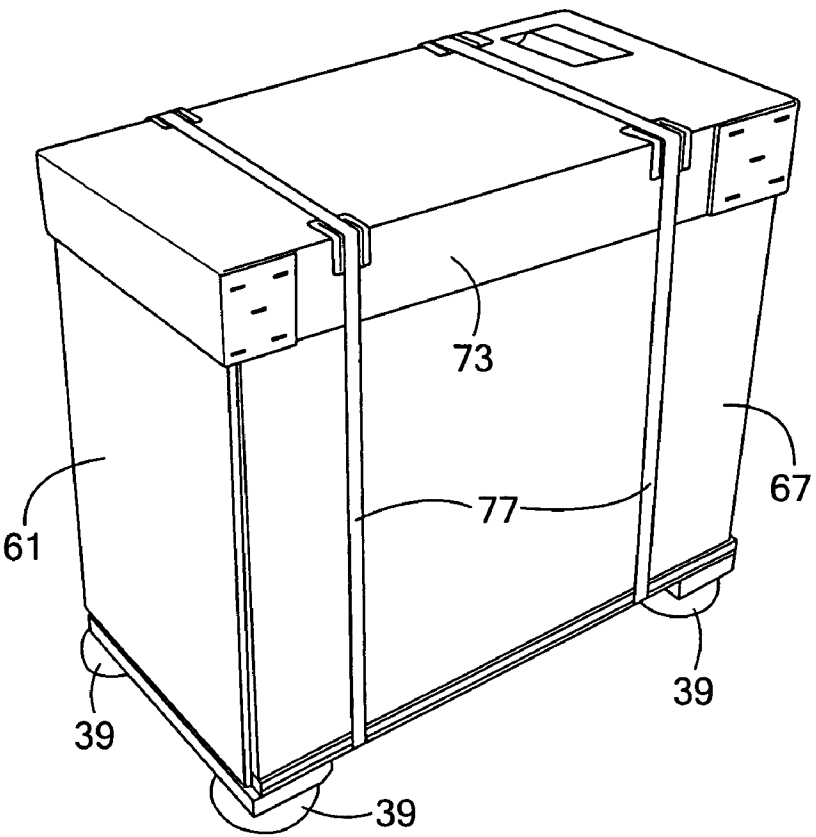
FIG. 10 is a perspective view of the fully assembled shipping container.
Figure 9:
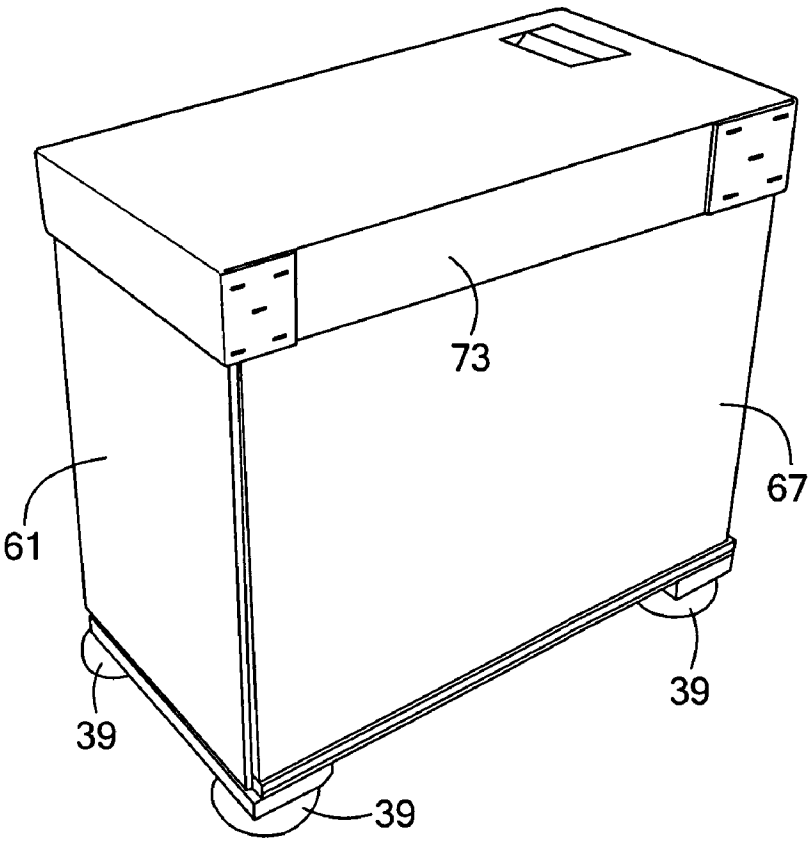
FIG. 9 is a perspective view similar to FIG. 8 but with the ramp raised and the sheet and cover placed over the sleeve.

Once in place, bottom supports 63 and 65 are inserted underneath housing 13 of chiller 11 as shown in FIG. 7. Bottom supports 63 and 65 serve to restrict sideways movement of chiller 11 on base 26. Then sleeve 67 is placed over chiller 11. Then top cap 69 is placed over the top of chiller 11 as shown in FIG. 8 and sheet 71 placed over top cap 69. Then, ramp 61 is raised so that it is vertical and secured to sleeve 67 using hot glue (not shown) or Velcro (not shown). Then, cover 73 is placed over sleeve 67 and ramp 61. Then, strap guides 75 are placed on cover 73 and straps 77 placed around sleeve 67 and cover 73 to secure the entire unit as shown in FIG. 10.

Chiller 11 may be removed from shipping container 25 by reversing the steps described in detail above.

Because chiller 11 is never lifted up but is only rolled, pushed and slid when it is being loaded into shipping container 11, and being unloaded from shipping container 11, the entire loading operation can be achieved by only one person. Two or more people are not needed or required.

The embodiment shown in the present invention is intended to be merely exemplary and those skilled in the art shall be able to make numerous variation and modifications to it without departing from the spirit of the present invention. All such variations and modifications are intended to be within the scope of the present invention as defined in the appended claims.

What is claimed is:

1. A method for loading a product mounted on casters into a shipping container, the product including a housing having a bottom wall, the shipping container including a base, a ramp hingedly mounted onto the base, a removable sleeve, a cover, and a pair of support members, the pair of support members being fixedly mounted on the base, each support member comprising an elongated block of material having a top surface and a tapered front end and a stop at the rear end and a strip of low friction material fixed to the top surface, the method comprising:

(a) lowering the ramp, then (b) rolling the product up the ramp, then (c) pushing the product up the tapered front end of each block of material, the bottom wall of the product being in contact with the block of material of each support member, then (d) sliding the product along the two strips of low friction material to the stop at each end of the elongated block of material, the housing of the product being seated on the two support members and the casters being suspended on either side of the pair of support members and spaced up from the base of the shipping container, then (e) placing the sleeve over the product, then (f) raising the ramp, and then (g) placing the cover over the sleeve and the ramp.

2. The method of claim 1 and further including securing the ramp to the sleeve after the ramp is raised and before the cover is placed over the sleeve and the ramp.

* * * * *